US009204220B2

(12) United States Patent
Chang

(10) Patent No.: US 9,204,220 B2
(45) **Date of Patent: *Dec. 1, 2015**

(54) RFID TRANSCEIVER FOR REMOTE CONTROL

(71) Applicant: FAVEPC Inc., Chu-Pei, Hsin-Chu County (TW)

(72) Inventor: Shao-Chang Chang, Chu-Pei (TW)

(73) Assignee: FAVEPC INC., Chu-Pei, Hsin-Chu County (TW)

( * ) Notice: Subject to any disclaimer, the term of this patent is extended or adjusted under 35 U.S.C. 154(b) by 382 days.

This patent is subject to a terminal disclaimer.

(21) Appl. No.: 13/793,534

(22) Filed: Mar. 11, 2013

(65) Prior Publication Data

US 2014/0254803 A1 Sep. 11, 2014

(51) Int. Cl.
*H04R 5/04* (2006.01)

(52) U.S. Cl.
CPC ..... *H04R 5/04* (2013.01)

(58) Field of Classification Search
None
See application file for complete search history.

(56) References Cited

U.S. PATENT DOCUMENTS

| | | | | |
|---|---|---|---|---|
| 2005/0008168 | A1* | 1/2005 | Pompei | 381/77 |
| 2008/0151975 | A1* | 6/2008 | Cheng et al. | 375/219 |
| 2010/0245113 | A1* | 9/2010 | Schmehl et al. | 340/825.49 |
| 2011/0002471 | A1* | 1/2011 | Wihardja et al. | 381/56 |
| 2011/0138444 | A1* | 6/2011 | Kang et al. | 726/3 |
| 2013/0268278 | A1* | 10/2013 | Li et al. | 704/500 |
| 2014/0023091 | A1* | 1/2014 | Ginn et al. | 370/474 |
| 2014/0253360 | A1* | 9/2014 | Chang | 341/176 |
| 2014/0254326 | A1* | 9/2014 | Chang | 367/197 |
| 2014/0254803 | A1* | 9/2014 | Chang | 381/28 |

* cited by examiner

*Primary Examiner* — Paul Huber
(74) *Attorney, Agent, or Firm* — Muncy, Geissler, Olds & Lowe, P.C.

(57) ABSTRACT

A transceiver for remote control, the transceiver includes an amplifier configured to receive an audio signal from a first electronic device and amplify the audio signal; a transmission module electrically connected to the amplifier to receive the amplified audio signal and generating a first carrier signal; a power supply connected to the transmission module; and a receiver module connected to the first electronic device and the power supply, wherein the amplified audio signal is configured to modulate the first carrier signal generated by the transmission module, and the audio signal is one of a left channel audio signal and a right channel audio signal from the first electronic device.

20 Claims, 3 Drawing Sheets

RFID TRANSCEIVER FOR REMOTE CONTROL

BACKGROUND OF THE INVENTION

The present invention generally relates to a transceiver and, more particularly, to a radio frequency identification (RFID) transceiver having a matching function for remote control.

RFID technology has been widely used various products such as be used to remotely control various consumer electronic products, for example, stereo systems, digital video disc (DVD) players and game consoles, etc. An RFID control may have to verify an electronic product via antenna matching to establish a communication channel.

However, an RFID remote control may sometimes inevitably match unintended electronic products. FIG. 1 is a schematic diagram illustrating an RFID remote control and a plurality of electronic devices. Referring to FIG. 1, electronic devices 21, 22, 23, 24 and 25 may be located at different distances from the RFID remote control 1. The transmitter (not shown) resided in the RFID remote control 1 may have enough emitting power so that each the electronic devices 21, 22, 23, 24 and 25 may be able to receive RF signals from the RFID remote control 1. Accordingly, not only the target electronic device, for example, product 23 but the other devices 21, 22, 24 and 25 may receive the RF signal.

It may therefore be desirable to have a remote control which is equipped with a transceiver to acquire an identification (ID) code of a target device so as to achieve the matching with the target device.

BRIEF SUMMARY OF THE INVENTION

Examples of the present invention may provide a transceiver for remote control, the transceiver includes an amplifier configured to receive an audio signal from a first electronic device and amplify the audio signal; a transmission module electrically connected to the amplifier to receive the amplified audio signal and generating a first carrier signal; a power supply connected to the transmission module; and a receiver module connected to the first electronic device and the power supply, wherein the amplified audio signal is configured to modulate the first carrier signal generated by the transmission module, and the audio signal is one of a left channel audio signal and a right channel audio signal from the first electronic device.

Some examples of the present invention may provide a transceiver for remote control, the transceiver includes an amplifier connected to a first electronic device; a transmission module electrically connected to the amplifier; and a receiver module electrically connected to the first electronic device; wherein the amplifier receives an audio signal from the first electronic device and the audio signal is one of a left channel audio signal and a right channel audio signal.

Some examples of the present invention may provide a transceiver for remote control, the transceiver comprising: an amplifier connected to a first electronic device; a transmission module electrically connected to the amplifier; an attenuation circuit electrically connected to the transmission module; and a receiver module electrically connected to the first electronic device; wherein the receiver module receives a carrier signal from a second electronic device and the carrier signal comprises identification information of the second electronic device.

Additional features and advantages of the present invention will be set forth in part in the description which follows, and in part will be obvious from the description, or may be learned by practice of the invention. The features and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings examples which are presently preferred. It should be understood, however, that the invention is not limited to the precise arrangements and instrumentalities shown.

In the drawings.

DETAILED DESCRIPTION OF THE INVENTION

Reference will now be made in detail to the present examples of the invention, examples of which are illustrated in the accompanying drawings. Wherever possible, the same reference numbers will be used throughout the drawings to refer to the same or like parts.

Figure 1:
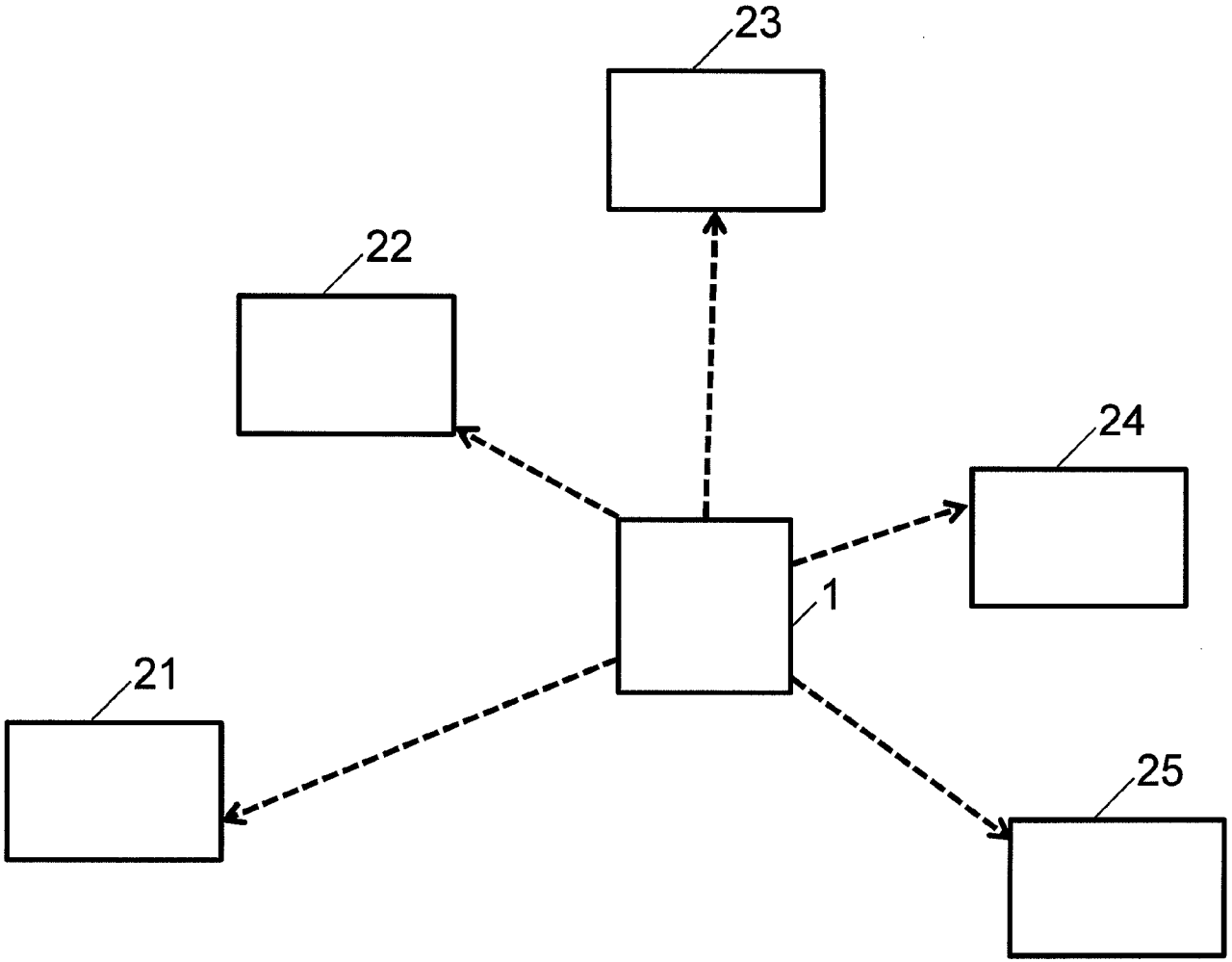
FIG. 1 (PRIOR ART)
FIG. 1 is a schematic diagram of consumer electronics in an RFID remote control system which employs a portable electronic device.
Figure 2:
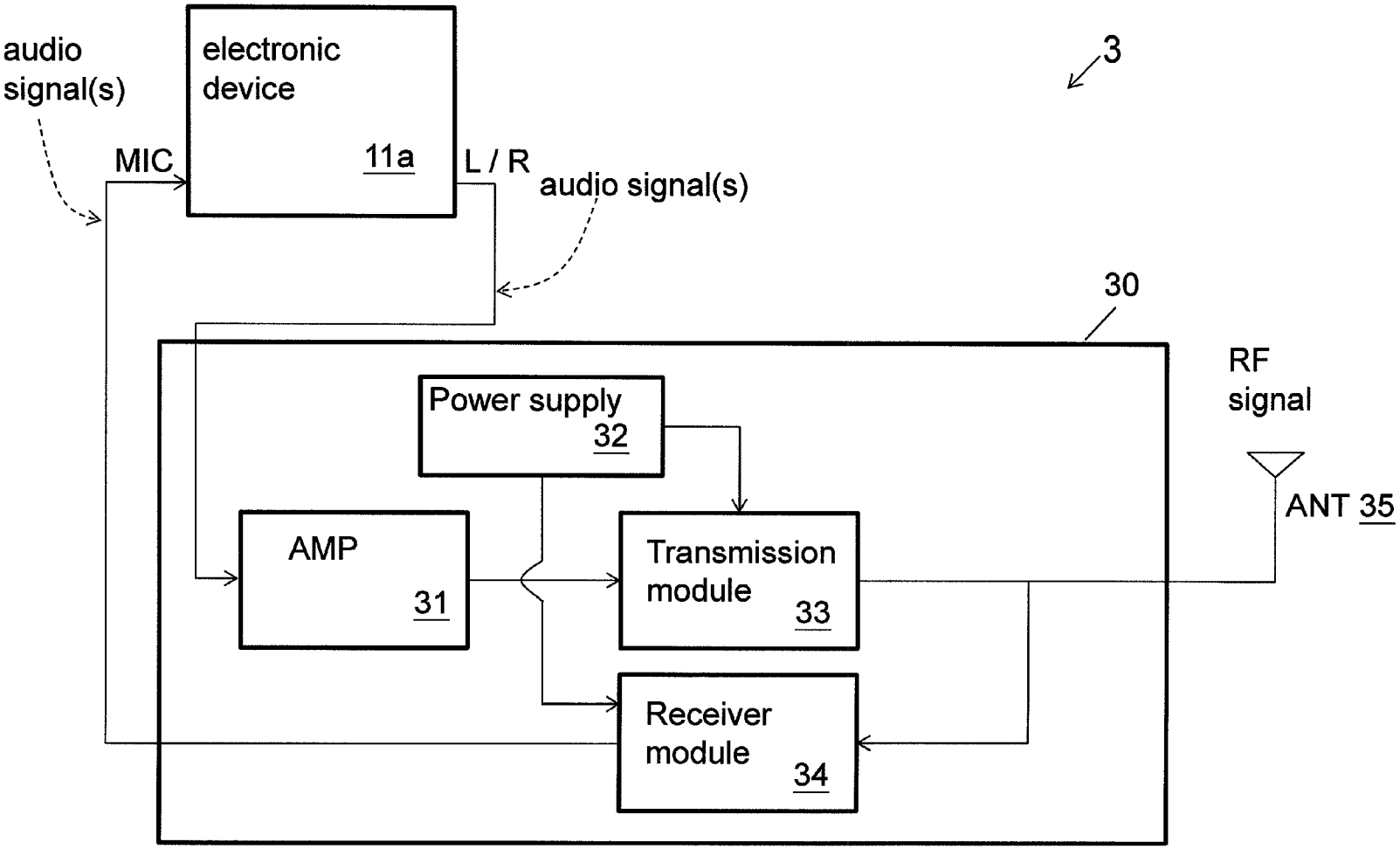
FIG. 2 is a block diagram of a transceiver of the remote control in accordance with an example of the present invention.

FIG. 2 is a block diagram of a transceiver 30 of a remote control 3 in accordance with an example of the present invention. Referring to FIG. 2, the remote control 3 may include an electronic device 11*a* and a transceiver 30, and the transceiver 30 may be connected to the electronic device 11*a* via an audio connector (not shown), such as a phone connector, microphone jack, phone plug, etc. The electronic device 11*a* may include a smart phone, a tablet computer, a laptop computer or the like. Furthermore, the transceiver 30 may include an amplifier 31 such as an operational amplifier (OP AMP), a power supply 32, a transmission module 33 and a receiver module 34. The amplifier 31 may be connected to the transmission module 33, and the power supply 32 may provide power to the transmission module 33. The receiver module 34 may be connected to the electronic device 11 a via the audio connector and receive a modulated carrier signal from an external electronic device (not shown).

The AMP 31 may receive a left channel audio signal L from an electronic device 11*a* and amplify the left channel audio signal L. The transmission module 33 may then receive the amplified left channel audio signal L and generate a carrier signal. The amplified left channel audio signal L may be configured to modulate the carrier signal generated by the transmission module 33. In other words, the transmission module 33 may be configured to generate the carrier signal in accordance with the amplified left channel audio signal L. The carrier signal may contain the information of interests. An antenna 35 may be configured to convert the carrier signal to an RF signal. The RF signal may then be transmitted via the antenna 35 to an external electronic device (not shown). In the present example, the antenna 35 may be placed external to the transceiver 30, however, the antenna 35 may be incorporated into the transceiver 30 in another examples.

The transmission module 33 may need no extra modulator to modulate the carrier signal generated by the transmission module 33. The left channel audio signal L from the electronic device 11*a*, which may be received and amplified by the AMP 31, may be used to modulate the carrier signal generated by the transmission module 33.

The receiver module 34 may be configured to receive a carrier signal from an external electronic device (not shown) via the antenna 35. The carrier signal received by the receiver module 34 may then be converted to an audio signal, such as a microphone (MIC) channel audio signal. The received carrier signal by the receiver module 34 may contain information, such as an identification code (ID code), to verify the external electronic device and establish a communication channel between the remote control 3 and the external electronic device. The electronic device 11*a* may then receive the audio signal via the aforesaid audio connector and process the audio signal to retrieve the ID code.

In another example of the present invention, the left channel audio signal L and the right channel audio signal R may be switched. In other words, the right channel audio signal R may be received and amplified by AMP 31 to serve as the amplified audio signal to modulate the carrier signal generated by the transmission module 33.

An application software which is installed or stored in the electronic device 11*a* may change signal pattern of each of the left channel audio signal L and right channel audio signal R. Signals L and R having pattern given by the application software may be used to cooperate with the transceiver 30. In other words, the application software in the electronic device may control the generation of the left channel audio signal L and the right channel audio signal R. Furthermore, the application software may be used to process the received audio signal to acquire the ID code and store the ID code in the electronic device 11*a*. In another example of the present invention, the ID code may also be generated by a random number generator resides in the electronic device 11*a*. Furthermore, the ID code may be associated with a product serial number, personal identification number (PIN) and phone number, etc.

Figure 3:
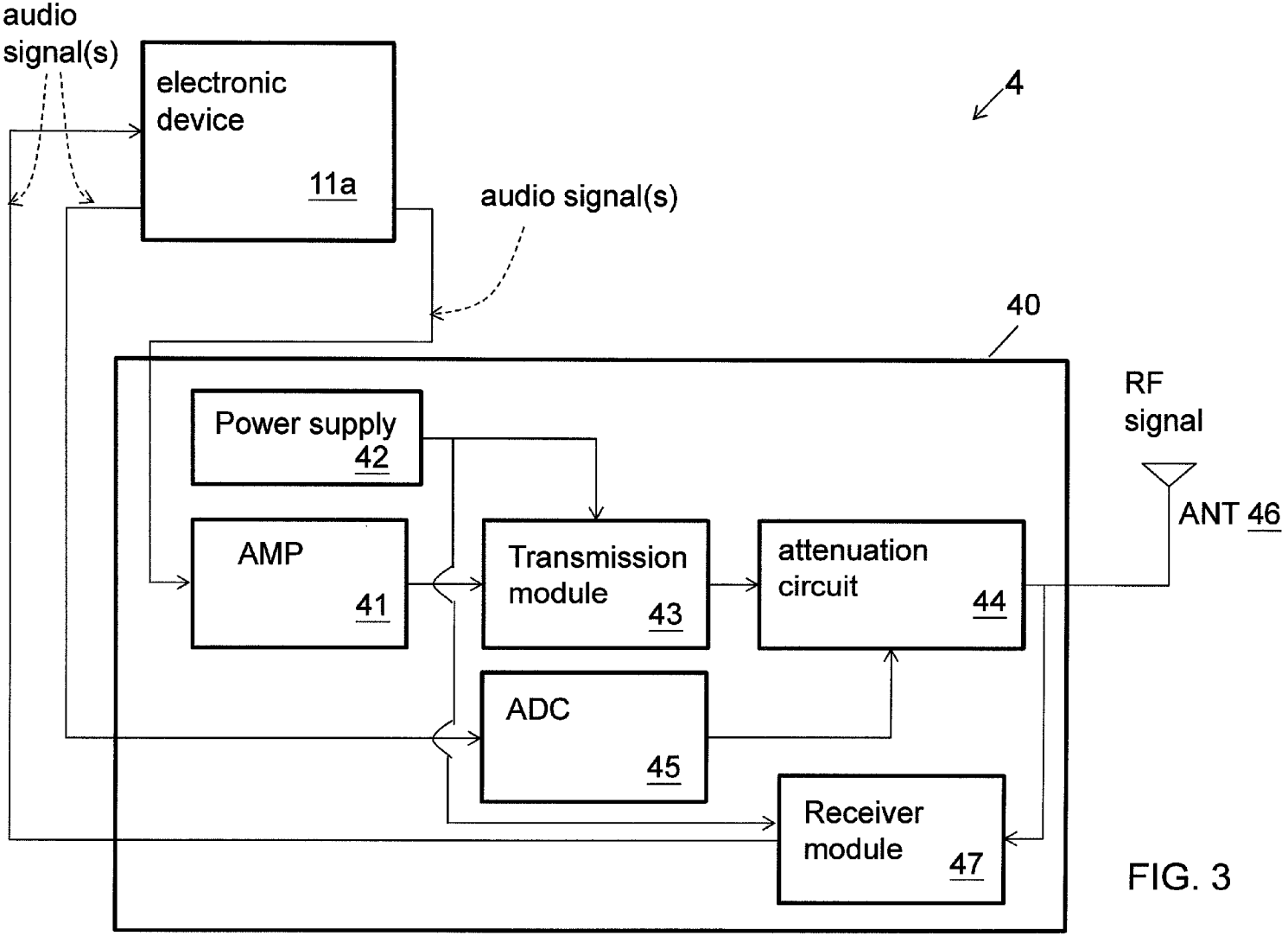
FIG. 3 is a block diagram of a transceiver of the remote control in accordance with another example of the present invention.

FIG. 3 is a block diagram of a transceiver 40 of a remote control 4 in accordance with another example of the present invention. Referring to FIG. 3, the transceiver 40 may be similar to the transceiver 30 as described and illustrated with reference to FIG. 2 except that, transceiver 40 may further include an attenuation circuit 44 and analog-to-digital converter (ADC) 45. The transmission module 43 and the receiver module 47 of the transceiver 40 may be similar to the transmission module 33 and the receiver module 34 described and illustrated with reference to FIG. 2. The AMP 41, the transmission module 43 and the attenuation circuit 44 may be connected in series. The power supply 42 may provide power to the transmission module 43 and the receiver module 47, respectively. The AMP 41, the ADC 45 and the receiver module 47 may be connected to the electronic device 11*a* via the aforesaid audio connector. The receiver module 47 may be configured to receive a carrier signal from an external electronic device (not shown) via the antenna 46.

In the present example, The AMP 41 may receive a left channel audio signal L from an electronic device 11*a* and amplify the left channel audio signal L. The transmission module 43 may then receive the amplified left channel audio signal L and generate a carrier signal. The amplified left channel audio signal L may be configured to modulate the carrier signal generated by the transmission module 43. In other words, the transmission module 43 may be configured to generate the carrier signal in accordance with the amplified left channel audio signal L. The carrier signal may contain information of interests. The ADC 45 may receive a right channel audio signal R from the electronic device 11*a* and convert the right channel audio signal R to a digital signal as an activation signal. The activation signal may be used to activate the attenuation circuit 44 to attenuate the carrier signal generated by the transmission module 43. The attenuation circuit 44 may be able to generate an attenuated carrier signal. An antenna 46 may be configured to convert the attenuated carrier signal to an RF signal. The RF signal may then be transmitted via the antenna 46 to an external electronic device (not shown). In the present example, the antenna 46 may be placed external to the transceiver 40, however, the antenna 46 may be incorporated into the transceiver 40 in another examples.

The transmission module 43 may need no extra modulator to modulate the carrier signal generated by the transmission module 43. The left channel audio signal L from the electronic device 11*a*, which may be received and amplified by the AMP 41, may be used to modulate the carrier signal generated by the transmission module 43. Furthermore, the right channel audio signal R from the electronic device 11*a*, which may be received and converted to a digital signal by the ADC 45, and the digital signal may be used to activate the attenuation circuit 44. In another example, the left channel audio signal L may be used to activate the attenuation circuit 44 and the right channel audio signal R may be used to modulate the carrier signal generated by the transmission module 43.

The receiver module 47 may be configured to receive a carrier signal from an external electronic device (not shown) via the antenna 46. The carrier signal received by the receiver module 47 may then be converted to an audio signal, such as a microphone (MIC) channel audio signal. The received carrier signal by the receiver module 47 may contain information, such as an identification code (ID code), to verify the external electronic device and establish a communication channel between the remote control 4 and the external electronic device. The electronic device 11*a* may then receive the audio signal via the aforesaid audio connector and process the audio signal to retrieve the ID code. In another example of the present invention, the ID code may also be generated by a random number generator resides in the electronic device 11*a*. Furthermore, the ID code may be associated with a product serial number, personal identification number (PIN) and phone number, etc.

In another example of the present invention, the left channel audio signal L and the right channel audio signal R may be switched. In other words, the right channel audio signal R may be received and amplified by AMP 41 to serve as the amplified audio signal to modulate the carrier signal generated by the transmission module 43.

An application software which is installed or stored in the electronic device 11*a* may change signal pattern of each of the left channel audio signal L and right channel audio signal R. Signals L and R having pattern given by the application software may be used to cooperate with the transceiver 40. In other words, the application software in the electronic device may control the generation of the left channel audio signal L and right channel audio signal R. Furthermore, the application software may be used to process the received audio signal to acquire an ID code and store the ID code in the electronic device 11*a*. In another example of the present invention, the ID code may also be generated by a random number generator resides in the electronic device 11*a*. Furthermore, the ID code may be associated with a product serial number, personal identification number (PIN) and phone number, etc.

It will be appreciated by those skilled in the art that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

Further, in describing representative examples of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

I claim:

1. A transceiver for remote control, the transceiver comprising:

an amplifier configured to receive an audio signal from a first electronic device and amplify the audio signal;

a transmission module electrically connected to the amplifier to receive the amplified audio signal and generating a first carrier signal;

a power supply connected to the transmission module; and a receiver module connected to the first electronic device and the power supply, wherein the amplified audio signal is configured to modulate the first carrier signal generated by the transmission module, and the audio signal is one of a left channel audio signal and a right channel audio signal from the first electronic device.

2. The transceiver of claim 1, wherein the amplifier is connected to the first electronic device via a first audio connector.

3. The transceiver of claim 1, wherein the receiver module is connected to the first electronic device via a second audio connector.

4. The transceiver of claim 1, wherein the first audio connector is different from the second audio connector.

5. The transceiver of claim 1, wherein the receiver module is configured to receive a second carrier signal from a second electronic device.

6. The transceiver of claim 5, wherein the second carrier signal comprises identification information of the second electronic device.

7. The transceiver of claim 6, wherein an application software in the first electronic device controls the generation of the audio signal and retrieves the identification information from the second carrier signal.

8. A transceiver for remote control, the transceiver comprising:

an amplifier connected to a first electronic device;

a transmission module electrically connected to the amplifier; and a receiver module electrically connected to the first electronic device;

wherein the amplifier receives an audio signal from the first electronic device and the audio signal is one of a left channel audio signal and a right channel audio signal.

9. The transceiver of claims 8, wherein the amplifier connects to the first electronic device via a first audio connector and amplifies the audio signal.

10. The transceiver of claims 9, wherein the receiver module is connected to the first electronic device via a second audio connector.

11. The transceiver of claim 10, wherein the first audio connector is different from the second audio connector.

12. The transceiver of claims 8, wherein the transmission module receives the amplified audio signal and generates a first carrier signal.

13. The transceiver of claims 12, wherein the transmission module uses the amplified audio signal to modulate the first carrier signal.

14. The transceiver of claims 8, wherein the receiver module receives a second carrier signal from a second electronic device.

15. The transceiver of claim 14, wherein the second carrier signal comprises identification information of the second electronic device.

16. The transceiver of claim 15, wherein an application software in the first electronic device controls the generation of the audio signal and retrieves the identification information from the second carrier signal.

17. A transceiver for remote control, the transceiver comprising:

an amplifier connected to a first electronic device;

a transmission module electrically connected to the amplifier;

an attenuation circuit electrically connected to the transmission module; and a receiver module electrically connected to the first electronic device;

wherein the receiver module receives a carrier signal from a second electronic device and the carrier signal comprises identification information of the second electronic device.

18. The transceiver of claim 17 further comprising an analog-to-digital converter connected to the attenuation circuit.

19. The transceiver of claim 18, wherein the analog-to-digital converter is configured to receive a first audio signal from the first electronic device and generate a digital signal to activate the attenuation circuit, wherein the first audio signal is one of a left channel audio signal and a right channel audio signal.

20. The transceiver of claim 19, wherein the amplifier receives a second audio signal from the first electronic device and the second audio signal is one of the left channel audio signal and the right channel audio signal other than the first audio signal.

* * * * *